US011194292B2

(12) United States Patent
Thiry et al.

(10) Patent No.: US 11,194,292 B2
(45) Date of Patent: Dec. 7, 2021

(54) SCREW-DOWN ORIENTABLE CROWN

(71) Applicant: MECO SA, Grenchen (CH)

(72) Inventors: Rémy Thiry, Maîche (FR); Ricardo Marcos, Worben (CH)

(73) Assignee: MECO SA, Grenchen (CH)

( * ) Notice: Subject to any disclaimer, the term of this patent is extended or adjusted under 35 U.S.C. 154(b) by 0 days.

(21) Appl. No.: 16/921,094

(22) Filed: Jul. 6, 2020

(65) Prior Publication Data

US 2021/0109482 A1 Apr. 15, 2021

(30) Foreign Application Priority Data

Oct. 9, 2019 (EP) ..... 19202193

(51) Int. Cl.
*G04B 37/10* (2006.01)
*G04B 3/04* (2006.01)
*G04D 3/00* (2006.01)

(52) U.S. Cl.
CPC ..... *G04B 37/103* (2013.01); *G04B 3/041* (2013.01); *G04B 3/043* (2013.01); *G04D 3/0012* (2013.01)

(58) Field of Classification Search
CPC ..... G04B 37/103; G04B 3/041; G04B 3/043; G04B 37/04; G04B 37/10; G04B 37/106; G04D 3/0012
USPC ..... 368/319
See application file for complete search history.

(56) References Cited

U.S. PATENT DOCUMENTS

| | | | | |
|---|---|---|---|---|
| 9,110,444 | B2 * | 8/2015 | Knuchel | G04B 3/043 |
| 10,228,656 | B2 * | 3/2019 | Waeckerlin | G04B 3/043 |
| 2013/0114383 | A1 * | 5/2013 | Gourdin | G04B 3/04 368/308 |
| 2014/0071797 | A1 | 3/2014 | Knuchel et al. | |
| 2014/0169144 | A1 * | 6/2014 | Briswalter | G04B 37/103 368/319 |

FOREIGN PATENT DOCUMENTS

| | | |
|---|---|---|
| EP | 2 592 500 A1 | 5/2013 |
| EP | 2 718 770 B1 | 1/2017 |
| JP | 2014-519041 A | 8/2014 |

(Continued)

OTHER PUBLICATIONS

European Search Report for EP 19 20 2193, dated Mar. 23, 2020.

(Continued)

*Primary Examiner* — Edwin A. Leon
(74) *Attorney, Agent, or Firm* — Sughrue Mion, PLLC

(57) ABSTRACT

A screw-down orientable crown (200) for watch case (100), including a tube (11) that can be axially inserted into a case housing (90), and a handling body (1) including a pattern (19) and a relief (15) extending axially and, in the coupled position, cooperating for indexing the pattern (19) relative to the case (100) with a complementary relief (55) that a fixed pipe (5) includes which is pushed back from the body (1) by a spring (12), and including an axial stop (3) fixed to the body (1) to axially trap the fixed pipe (5) with a stroke corresponding to the deformation of the spring (12) to enable the disconnection, by a compression of the body (1), between the relief (15) and the complementary relief (55), which relief (15) is carried by a trunnion (4) integral with the body (1) and which is inside the fixed pipe (5).

16 Claims, 4 Drawing Sheets

(56) References Cited

FOREIGN PATENT DOCUMENTS

| | | | |
|---|---|---|---|
| JP | 2018-40609 | A | 3/2018 |
| WO | 01/40881 | A1 | 6/2001 |

OTHER PUBLICATIONS

Communication dated Aug. 3, 2021 by the Chinese Patent Office in Chinese Application No. 202011070883.5.
Communication dated Aug. 31, 2021 by the Japanese Patent Office in application No. 2020-139088.

* cited by examiner

SCREW-DOWN ORIENTABLE CROWN

CROSS REFERENCE TO RELATED APPLICATIONS

This application claims priority to European Patent Application No. 19202193.9 filed Oct. 9, 2019, the entire contents of which are incorporated herein by reference.

FIELD OF THE INVENTION

The invention relates to a screw-down orientable crown for a watch case including a middle part with at least one through housing for receiving said screw-down orientable crown, which screw-down orientable crown is arranged to cooperate with said housing and to seal it tightly, said screw-down orientable crown including a pattern on an end face or in its vicinity, said screw-down orientable crown including, on the one hand a sub-assembly including a crown body that can be manipulated by a user and including said pattern, and on the other hand a tube arranged to be screwed-down or driven into said housing in said axial direction, which are axially movable in an axial direction relative to each other.

The invention also relates to a watch case, including a middle part with at least one through housing for receiving such a screw-down orientable crown.

The invention also relates to a timepiece, in particular a watch, including such a case.

The invention also relates to a method for assembling such a screw-down orientable crown.

The invention also relates to a method for mounting such a screw-down orientable crown on a watch case.

BACKGROUND OF THE INVENTION

Screw-down crowns are commonly used to equip watches for the purpose of improving their water-resistance at the recess of a control organ, such as a winding or control rod. This type of crown has the particularity of being able to take an unscrewed-down position wherein the watch can be wound, time set, regulated, or other, and a screwed-down position wherein the crown is screwed-down and blocked on a tube driven or screwed in the middle part of the watch case in order to compress a gasket, thus improving the water-resistance of the watch. The screwed-down position is therefore that which corresponds to the normal position when the watch is worn and which is always more or less the same, apart from the wear of the gasket.

The manufacture and mounting of these crowns screwed-down on watch cases are well known. However, the methods for mounting these crowns are poorly adapted to screwed-down crowns which carry on their end face an inscription or a pattern, for example a logo, a trademark or a similar sign, or else a relief, or to crowns which are not of revolution, whereas it is desirable that the user, or at least an after-sales service, can regulate the angular indexing of such a crown, in the screwed-down position, according to a particular desired orientation.

Indeed, the known mounting methods generally do not allow the crown to be brought into a determined orientation relative to the case after it has been screwed-down, which can harm the aesthetics of the case. This situation is of course unacceptable when these crowns equip luxury and high quality products.

The document EP2718770A1 in the name of OMEGA describes a screw-down orientable element comprising a cover and a device for regulating the angular orientation of this cover relative to a watch case. The device for regulating the angular orientation comprises a coupling element and indexing means between the cover and the coupling element, as well as return means which tend to keep the cover and the coupling element joined in rotation.

SUMMARY OF THE INVENTION

In particular, the invention has the purpose of overcoming the various disadvantages of these known techniques.

More specifically, a purpose of the invention is to provide a screw-down orientable crown adaptable to any watch case including a crown housing, for orienting this screw-down crown, produced according to a simple and economical construction.

The invention also has the purpose of providing a screw-down orientable crown which is more reliable than existing ones.

Thus, the invention relates to a screw-down orientable crown according to claim 1.

The invention also relates to a watch case, including a middle part with at least one through housing for receiving such a screw-down orientable crown.

The invention also relates to a timepiece, in particular a watch, including such a case.

The invention also relates to a method for assembling such a screw-down orientable crown.

The invention also relates to a method for mounting such a screw-down orientable crown on a watch case.

BRIEF DESCRIPTION OF THE DRAWINGS

Other features and advantages of the invention will appear more clearly upon reading the following description of a particular embodiment of the invention, given by way of simple illustrative and non-limiting example, and of the appended figures, among which.

DETAILED DESCRIPTION OF PREFERRED EMBODIMENTS

Figure 2:
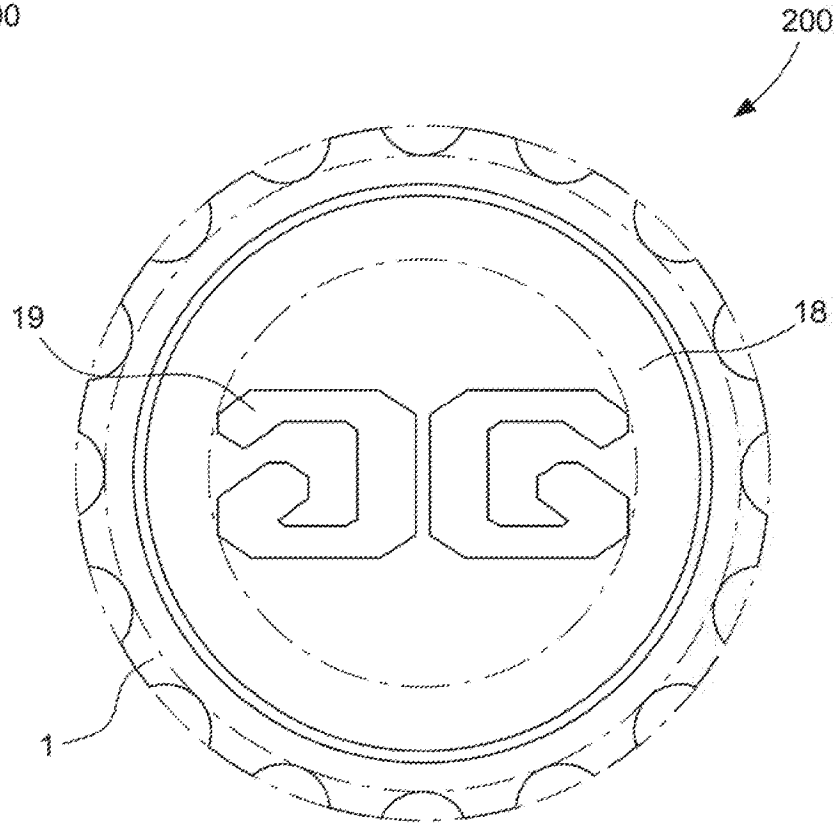
FIG. 2 is a top view of the crown of FIG. 1, and shows a pattern on a crown body which can be manipulated by the user.

The invention relates to a screw-down orientable crown 200 for a watch case 100. This case 100 conventionally includes a middle part 9, with at least one through housing 90 for receiving the screw-down orientable crown 200.

This screw-down orientable crown 200 is arranged to cooperate with the housing 90 and tightly seal it. The screw-down orientable crown 200 has a pattern 19 on an end face 18 or in its vicinity.

This screw-down orientable crown 200 includes, on the one hand a sub-assembly 20 including a crown body 1 which can be manipulated by a user and including the pattern 19, and on the other hand a tube 11, which are axially movable in an axial direction D relative to each other. This tube 11 is arranged to be screwed-down or driven into the housing 90 in the axial direction D.

According to the invention, the sub-assembly 20 includes, an indexing relief 15 integral with the crown body 1 which extends in the axial direction D, and which is arranged, in a coupled position, to complementarily cooperate with a complementary indexing relief 55 that a fixed pipe 5 includes, that the sub-assembly 20 includes. This complementary indexing relief 55 also extends in the axial direction D, and this fixed pipe 5 tends to be pushed back from the crown body 1 by at least one crown spring 12 interposed and captively mounted between the crown body 1 and the fixed pipe 5 which it tends to separate from one another. The crown spring 12 is here, without limitation, a conical or cup spring. In the absence of manipulation by the user, the crown spring 12 tends to separate the crown body 1 from the fixed pipe 5.

The indexing relief 15 is arranged, in a position disconnected by compression of the crown spring 12, to remain at an axial distance from the complementary indexing relief 55 and without cooperation therewith.

The cooperation between the indexing relief 15 and the complementary indexing relief 55 in the coupled position defines a discrete number of relative indexing positions corresponding to so many relative orientations of the pattern 19 relative to the case 100.

The sub-assembly 20 and the tube 11 are arranged to cooperate by screwing-down to an abutment position, which corresponds to a completely screwed-down position of the sub-assembly 20 in the tube 11.

And, according to the invention, the sub-assembly 20 includes an axial stop means 3, which is fixed to the crown body 1 to axially trap, in the axial direction D, the sub-assembly 20 with an axial stroke corresponding to the range of deformation of the crown spring 12 to enable the disconnection, by a compression of the crown body 1, between the indexing relief 15 and the complementary indexing relief 55.

More particularly, the sub-assembly 20 includes a movable pipe 10 including fixing means 101 arranged for fixing the screw-down orientable crown 200 to a control organ housed in a case 100. This movable pipe 10 is axially movable in the axial direction D against elastic return means 6, in particular a pipe spring, which is a helical spring in the variant illustrated by the figures, in a chamber 105 defined on the one hand by the fixed pipe 5 and on the other hand by the crown body 1, or by a trunnion 4 integral with the crown body 1, and in which chamber 105 the movable pipe 10 is captively mounted. This trunnion 4 can be permanently fixed to the crown body 1, by laser welding 140, or the like.

More particularly, the sub-assembly 20 is non-removable.

More particularly, the fixed pipe 5 fixed inside the crown body 1 has a threading 51, which is arranged to cooperate with a tapping 111 that the tube 11 includes.

More particularly, and as visible in the non-limiting variant illustrated by the figures, the indexing relief 15 and the complementary indexing relief 55 include complementary splines.

More particularly, the axial stop means 3 includes an annular ring with an internal flange including a front abutment support surface 33 substantially perpendicular to the axial direction D, and which is arranged to cooperate in abutment support with a front complementary abutment support surface 53 that an external flange 2 includes that the fixed pipe 5 includes.

More particularly, the crown body 1 carries a second axial stop means 9, which is arranged to directly or indirectly maintain the axial stop means 3 in the crown body 1. More particularly, this second axial stop means 9 is arranged to indirectly maintain the axial stop means 3 in the crown body 1, through at least one spacer 7 housed in the crown body 1. This spacer 7 can be permanently fixed in the crown body 1, for example by laser welding 137 or the like. More particularly, the second axial stop means 9 is arranged to indirectly maintain the axial stop means 3 in the crown body 1 through at least one gasket 8, which is arranged to cooperate with a gasket support surface 118 that the tube 11 includes and which is arranged to compress the gasket 8 in the fully screwed-down position of the sub-assembly 20 in the tube 11. This gasket support surface 118 is preferably oblique relative to the axial direction D, and is in particular a conical surface.

Figure 1:
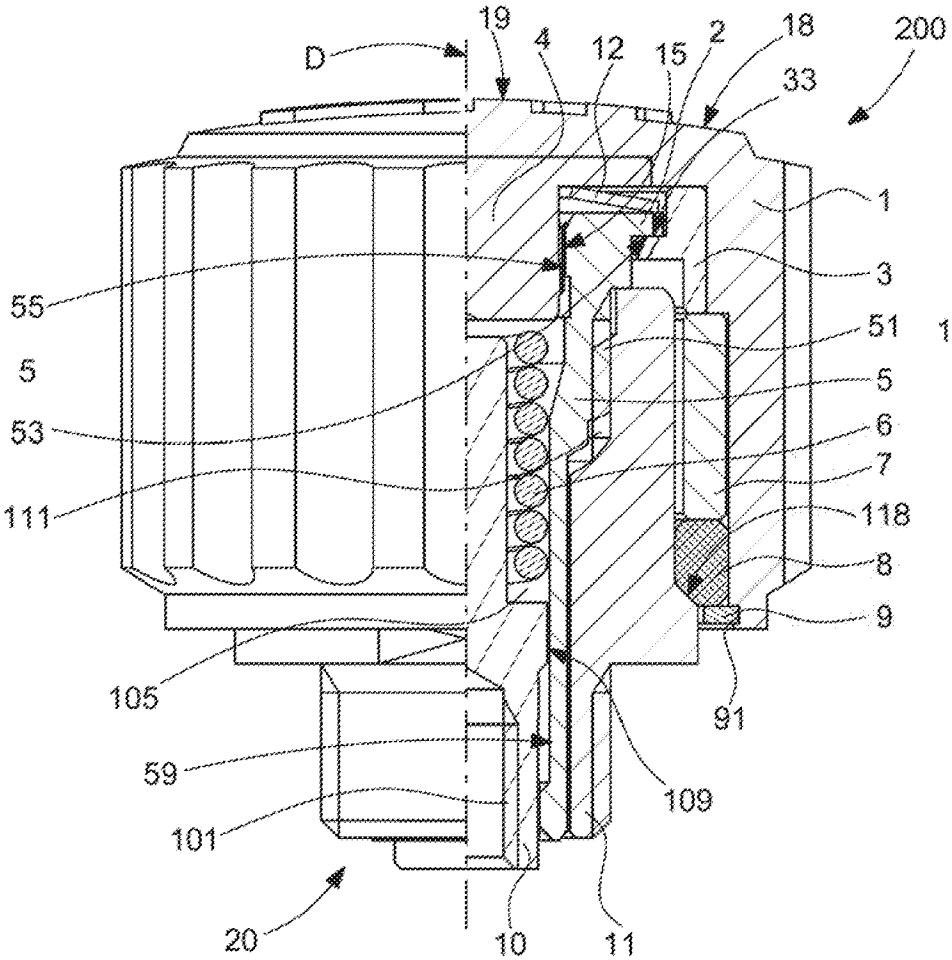
FIG. 1 is a partly side, and partly longitudinal sectional view, of a screw-down orientable crown according to the invention.
Figure 4:
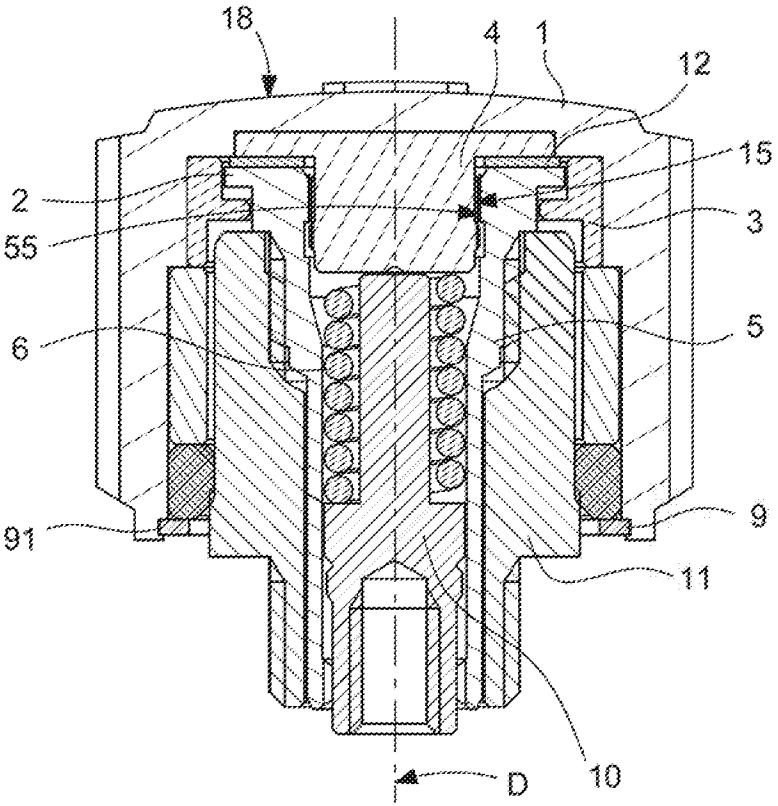
FIG. 4 is a sectional view of the same crown, in a compressed position wherein the user presses on the crown body, to perform the disconnection of the indexing relief and the complementary indexing relief, which are here disengaged from one another and the unmeshing of which enables the relative rotation between the crown body and the tube.
Figure 3:
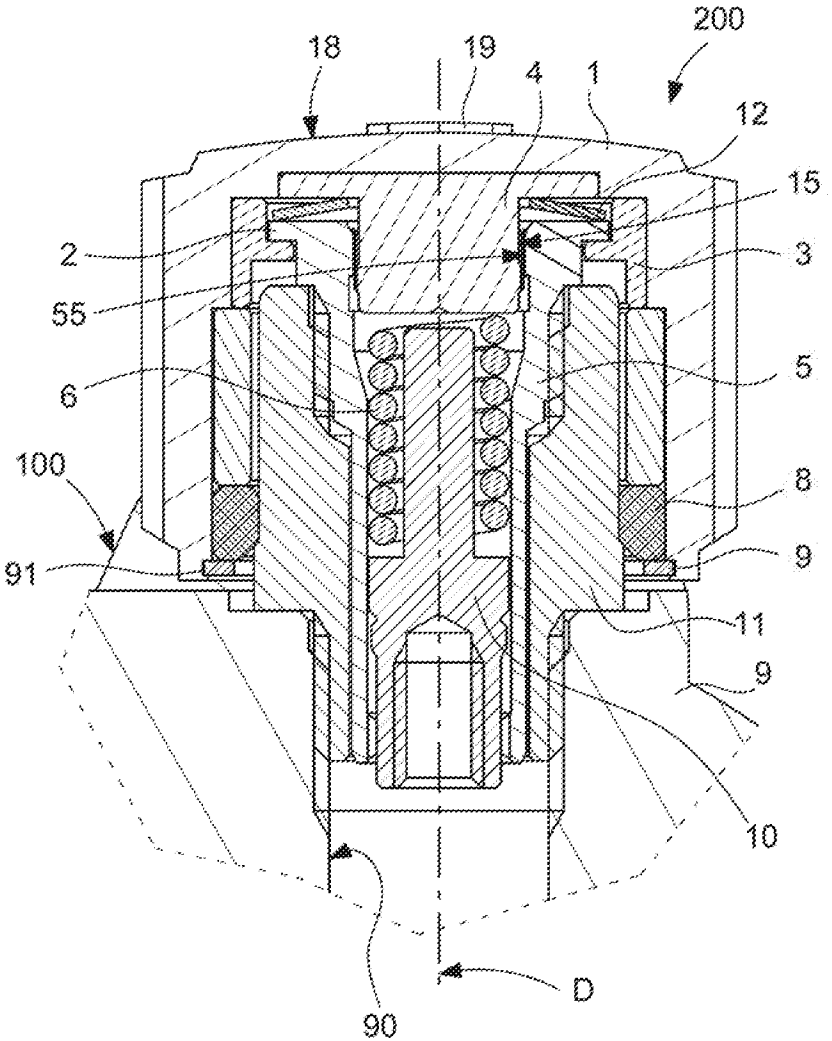
FIG. 3 is a sectional view of the same crown, which includes a tube screwed-down on a middle part, in a fully screwed-down position prior to disconnection; an indexing relief carried by a fixed pipe, and a complementary indexing relief integral with the crown body, and which here are splines, are engaged under the action of a conical crown spring.
Figure 6:
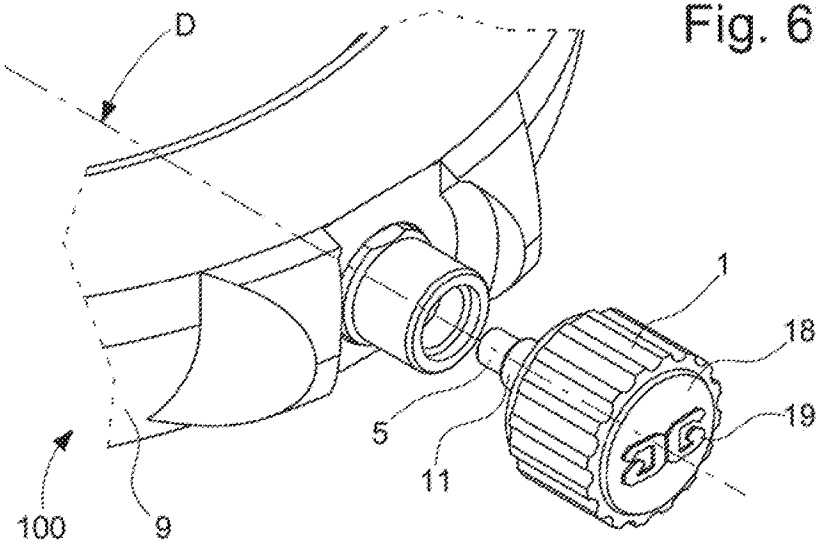
FIG. 6 is a perspective showing the crown tube screwed-down on the middle part of the watch case, and the presentation of the crown body including a sub-assembly constituting the coupling/disconnection mechanism, including the fixed pipe, wherein a movable pipe provided to cooperate with the inner mechanism of the watch intended to be controlled and/or regulated by the crown is captively mounted.
Figure 7:
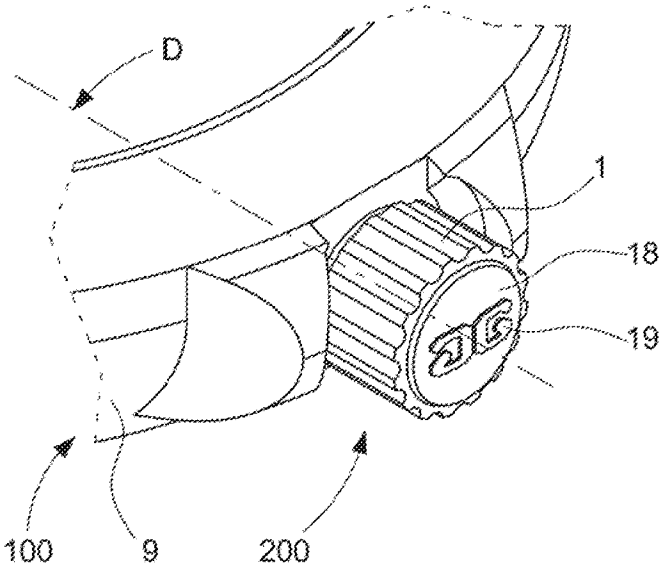
FIG. 7 is a perspective similar to FIG. 6, where the crown body is fully screwed-down on the tube as in FIG. 3, and where the user can index the pattern relative to the watch case by exerting a pressure on the crown body to disconnect the mechanism, rotate the crown body to the desired angular orientation, then by releasing his axial pressure on the crown body to re-couple the mechanism in its new indexed position.
Figure 5:
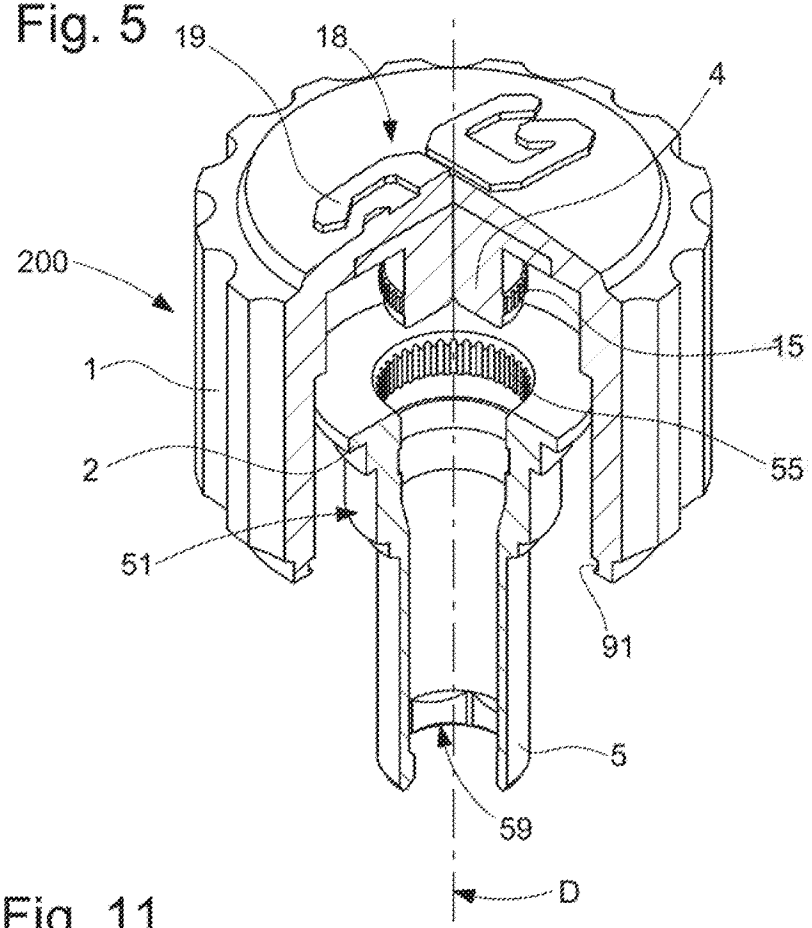
FIG. 5 is an exploded perspective, quarter removed, showing only the fixed pipe with its indexing relief in the shape of female spline, and the crown body with its complementary indexing relief in the shape of a male spline.
Figure 11:
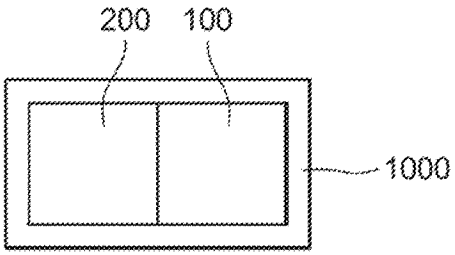
FIG. 11 is a block diagram showing a watch including a case provided with a screw-down orientable crown according to the invention.
Figure 10:
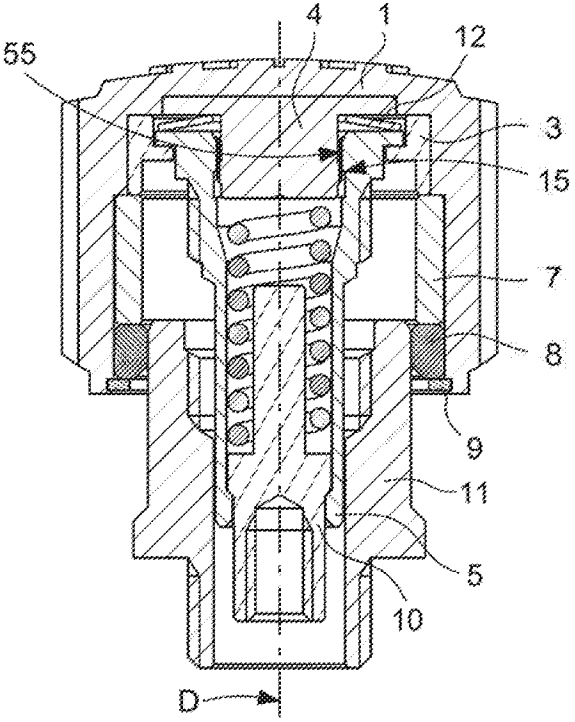
FIG. 10 is an unscrewed and drawn view of the crown, with the maximum stroke of the fixed pipe relative to the crown tube.
Figure 9:
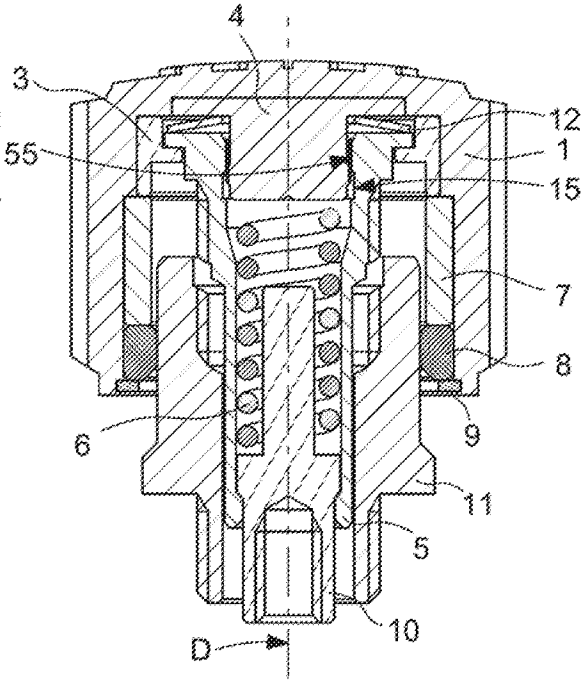
FIG. 9 is an unscrewed view of the crown, the threading of the fixed pipe being shown opposite the tapping of the middle part, but not yet screwed.
Figure 8:
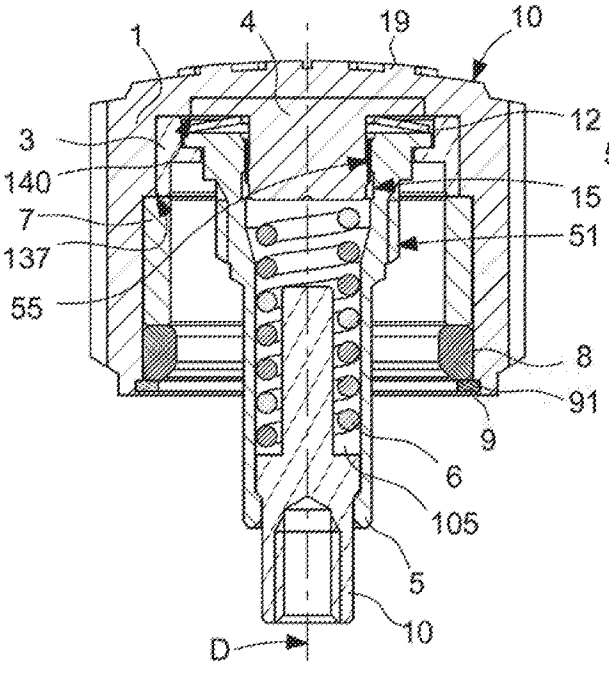
FIG. 8 shows, in longitudinal section, the mounting of the crown, in a position where a pipe spring, which tends to move the movable pipe away from the crown body, is in its maximum elongation (while it is in maximum compression in the positions of FIGS. 3 and 4)

More particularly, the crown body 1 includes at least one inner annular groove 91 for receiving the second axial stop means 9, which in particular but without limitation consists of a snap ring, as visible in FIG. 1. This groove 91 may also result from a rolling of a thread folding formed at the end of the crown body 1, after mounting this snap ring 9.

More particularly, the crown spring 12 includes at least one conical spring and/or at least one "Belleville" washer and/or at least one "Schnorr" washer.

According to the invention, the indexing relief 15 is carried by a trunnion 4 which is integral with the crown body 1, and which is inside the fixed pipe 5.

The invention also relates to a watch case 100, including a middle part 9 with at least one through housing 90 for receiving such a screw-down orientable crown 200.

The invention also relates to a timepiece, in particular a watch 1000, including such a case 100.

The invention also relates to a method for assembling such a screw-down orientable crown 200, comprising the following steps:

- preparing the sub-assembly 20 with the axial stop means 3 in the crown body 1, by inserting the indexing relief 15 into the complementary indexing relief 55, and internally equipping the crown body 1 with at least one gasket 8, and axially stopping the gasket 8 by a second axial stop means 9;
- preparing the tube 11 and screwing it on the sub-assembly 20.

The invention also relates to a method for mounting such a screw-down orientable crown 200 on such a case 100, comprising the following steps:

- assembling the screw-down orientable crown 200 according to the above assembly method;
- axially inserting the tube 11 in the axial direction D into the housing 90 of the middle part 8, in the middle part 100, and fixing it to the middle part 9 by screwing or driving to a screwing or respectively driving abutment position;
- measuring the angular orientation deviation of the pattern 19 relative to the desired position, and determining the number of indexing correction pitches;
- axially pressing the crown body 1 towards the middle part 9 then rotating the crown body 1 until the desired angular orientation is obtained;
- releasing the crown body 1.

More particularly, during the preparation of the sub-assembly 20:

- each crown spring 12 is disposed between on the one hand the crown body 1 or a trunnion 4 integral with the crown body 1 and on the other hand the fixed pipe 5;
- elastic return means 6 tending to push back a movable pipe 10 including fixing means 101 arranged for fixing the screw-down orientable crown 200 to a control organ housed in the case 100 are enclosed in a chamber 105 formed by the juxtaposition, on the one hand of the crown body 1 or respectively the trunnion 4 and on the other hand of the fixed pipe 5, the movable pipe 10 also being held captive in the chamber 105 by the fixed pipe 5;
- the indexing relief 15, carried by the crown body 1 or respectively the trunnion 4, is inserted into the complementary indexing relief 55 carried by the fixed pipe 5;
- the stroke of the fixed pipe 5 is axially limited relative to the crown body 1 by fixing the axial stop means 3 to the crown body 1 so that each crown spring 12 is held without clearance in the axial space delimited on the one hand by the crown body 1 or respectively the trunnion 4, and on the other hand by the fixed pipe 5;
- then an axial stop means 3 is irreversibly fixed to the crown body 1, to form a non-removable sub-assembly.

Thanks to these various aspects of the invention, there is a simple design screw-down orientable crown allowing the angular position of the crown to be indexed while including a reduced number of components.

Of course, the present invention is not limited to the example illustrated and is susceptible to various variants and modifications which will appear to a person skilled in the art. It will be understood that the invention is also applicable for example for a manual or automatic valve, as well as for a pusher, a corrector, or else a steerable bottom, or the like.

The invention claimed is:

1. A screw-down orientable crown (200) for a watch case (100) including a middle part (9) with at least one through housing (90) for receiving said screw-down orientable crown (200), the screw-down orientable crown (200) is arranged to cooperate with said housing (90) and tightly seal it, said screw-down orientable crown (200) including a pattern (19) on an end face (18), said screw-down orientable crown (200) including, a sub-assembly (20) including a crown body (1) that can be manipulated by a user and including said pattern (19), and a tube (11) arranged to be screwed-down or driven into said housing (90) in an axial direction (D), which are axially movable in said axial direction (D) relative to each other, where said sub-assembly (20) includes an indexing relief (15) integral with said crown body (1) extending in said axial direction (D) and arranged, in a coupled position, to complementarily cooperate with a complementary indexing relief (55) that a fixed pipe (5) includes, that said sub-assembly (20) includes and which extends in said axial direction (D) and tends to be pushed back from said crown body (1) by at least one crown spring (12) interposed and captively mounted between said crown body (1) and said fixed pipe (5) that it tends to separate from one another, and arranged, in a position disconnected by compression of said crown spring (12), to remain at an axial distance from said complementary indexing relief (55) and without cooperation therewith, the cooperation between said indexing relief (15) and said complementary indexing relief (55) defining a discrete number of relative indexing positions corresponding to so many relative orientations of said pattern (19) relative to said case (100), said sub-assembly (20) and said tube (11) being arranged to cooperate by screwing-down to an abutment position corresponding to a fully screwed-down position of said sub-assembly (20) in said tube (11), wherein said sub-assembly (20) includes an axial stop means (3) fixed to said crown body (1) to axially trap, in said axial direction (D), said fixed pipe (5) with an axial stroke corresponding to the range of deformation of said crown spring (12) to enable the disconnection, by a compression of said crown body (1), between said indexing relief (15) and said complementary indexing relief (55), and wherein said indexing relief (15) is carried by a trunnion (4) integral with said crown body (1) and which is inside said fixed pipe (5).

2. The screw-down orientable crown (200) according to claim 1, wherein said sub-assembly (20) is non-removable, and includes a movable pipe (10) including fixing means (101) arranged for fixing said screw-down orientable crown (200) to a control organ housed in a said case (100), which movable pipe (10) is axially movable in said axial direction (D) against elastic return means (6) in a chamber (105) defined by said fixed pipe (5) and by said trunnion (4) integral with said crown body (1).

3. The screw-down orientable crown (200) according to claim 1, wherein said fixed pipe (5) fixed inside said crown body (1) includes a threading (51) arranged to cooperate with a tapping (111) that said tube (11) includes.

4. The screw-down orientable crown (200) according to claim 1, wherein said indexing relief (15) and said complementary indexing relief (55) include complementary splines.

5. The screw-down orientable crown (200) according to claim 1, wherein said axial stop means (3) includes an annular ring with an internal flange including a front abutment support surface (33) substantially perpendicular to said axial direction (D), arranged to cooperate in abutment support with a front complementary abutment support surface (53) that an external flange (2) includes that said fixed pipe (5) includes.

6. The screw-down orientable crown (200) according to claim 1, wherein said crown body (1) carries a second axial stop means (9) arranged to directly or indirectly maintain said axial stop means (3) in said crown body (1).

7. The screw-down orientable crown (200) according to claim 6, wherein said second axial stop means (9) is arranged to indirectly maintain said axial stop means (3) in said crown body (1) through at least one spacer (7) housed in said crown body (1).

8. The screw-down orientable crown (200) according to claim 6, wherein said second axial stop means (9) is arranged to indirectly maintain said axial stop means (3) in said crown body (1) through at least one gasket (8) arranged to cooperate with a gasket support surface (118) that said tube (11) includes and which is arranged to compress said gasket (8) in said fully screwed-down position of said sub-assembly (20) in said tube (11).

9. The screw-down orientable crown (200) according to claim 6, wherein said crown body (1) includes at least one inner annular groove (91) for receiving said second axial stop means (9) which is a snap ring.

10. The screw-down orientable crown (200) according to claim 1, wherein said crown spring (12) includes at least one conical spring and/or at least one washer.

11. The watch case (100), including the middle part (9) with the at least one through housing (90) for receiving the screw-down orientable crown (200) according to claim 1.

12. A watch (1000) including the case (100) according to claim 11, and at least the screw-down orientable crown (200) arranged to cooperate with said housing (90).

13. A method for assembling a screw-down orientable crown (200) for a watch case (100) including a middle part (9) with at least one through housing (90) for receiving said screw-down orientable crown (200), the screw-down orientable crown (200) is arranged to cooperate with said housing (90) and tightly seal it, said screw-down orientable crown (200) including a pattern (19) on an end face (18), said screw-down orientable crown (200) including, a sub-assembly (20) including a crown body (1) that can be manipulated by a user and including said pattern (19), and a tube (11) arranged to be screwed-down or driven into said housing (90) in an axial direction (D), which are axially movable in said axial direction (D) relative to each other, where said sub-assembly (20) includes an indexing relief (15) integral with said crown body (1) extending in said axial direction (D) and arranged, in a coupled position, to complementarily cooperate with a complementary indexing relief (55) that a fixed pipe (5) includes, that said sub-assembly (20) includes and which extends in said axial direction (D) and tends to be pushed back from said crown body (1) by at least one crown spring (12) interposed and captively mounted between said crown body (1) and said fixed pipe (5) that it tends to separate from one another, and arranged, in a position disconnected by compression of said crown spring (12), to remain at an axial distance from said complementary indexing relief (55) and without cooperation therewith, the cooperation between said indexing relief (15) and said complementary indexing relief (55) defining a discrete number of relative indexing positions corresponding to so many relative orientations of said pattern (19) relative to said case (100), said sub-assembly (20) and said tube (11) being arranged to cooperate by screwing-down to an abutment position corresponding to a fully screwed-down position of said sub-assembly (20) in said tube (11), wherein said sub-assembly (20) includes an axial stop means (3) fixed to said crown body (1) to axially trap, in said axial direction (D), said fixed pipe (5) with an axial stroke corresponding to the range of deformation of said crown spring (12) to enable the disconnection, by a compression of said crown body (1), between said indexing relief (15) and said complementary indexing relief (55), and wherein said indexing relief (15) is carried by a trunnion (4) integral with said crown body (1) and which is inside said fixed pipe (5), the comprising the following steps:

preparing said sub-assembly (20) with said axial stop means (3) in said crown body (1), by inserting said indexing relief (15) into said complementary indexing relief (55), and internally equipping said crown body (1) with at least one gasket (8), and axially stopping said gasket (8) by a second axial stop means (9);

preparing said tube (11) and screwing it on said sub-assembly (20).

14. The method according to claim 13, further comprising:

axially inserting said tube (11) in said axial direction (D) into said housing (90) of said middle part (8), in the middle part (100), and fixing it to said middle part (9) by screwing or driving to a screwing or respectively driving abutment position;

measuring the angular orientation deviation of said pattern (19) relative to the desired position, and determining the number of indexing correction pitches;

axially pressing said crown body (1) towards said middle part (9) then rotating said crown body (1) until the desired angular orientation is obtained;

releasing said crown body (1).

15. The method of claim 14, wherein, during the preparation of said sub-assembly (20):

each said crown spring (12) is disposed between said trunnion (4) integral with said crown body (1) and said fixed pipe (5);

elastic return means (6) tending to push back a movable pipe (10) including fixing means (101) arranged for fixing said screw-down orientable crown (200) to a control organ housed in said case (100) are enclosed in a chamber (105) formed by the juxtaposition, of said trunnion (4) and of said fixed pipe (5), said movable pipe (10) also being held captive in said chamber (105) by said fixed pipe (5);

said indexing relief (15), carried by said trunnion (4), is inserted into said complementary indexing relief (55) carried by said fixed pipe (5);

the stroke of said fixed pipe (5) is axially limited relative to said crown body (1) by fixing said axial stop means (3) to said crown body (1) so that each said crown spring (12) is held without clearance in the axial space delimited by said trunnion (4), and by said fixed pipe (5);

then an axial stop means (3) is irreversibly fixed to said crown body (1), to form a non-removable sub-assembly.

16. The screw-down orientable crown (200) according to claim 1, wherein the axial stop means (3) is separated from the trunnion (4) and is outside of the fixed pipe (5).

* * * * *